US010171911B2

(12) United States Patent
Lee et al.

(10) Patent No.: US 10,171,911 B2
(45) Date of Patent: Jan. 1, 2019

(54) METHOD AND DEVICE FOR OUTPUTTING AUDIO SIGNAL ON BASIS OF LOCATION INFORMATION OF SPEAKER

(71) Applicant: SAMSUNG ELECTRONICS CO., LTD., Suwon-si (KR)

(72) Inventors: Yoon-jae Lee, Seoul (KR); Han-ki Kim, Suwon-si (KR); Sang-yoon Kim, Seoul (KR); Young-suk Song, Suwon-si (KR); Eun-mi Oh, Seoul (KR); Dong-hyun Lim, Seoul (KR); Ji-ho Chang, Suwon-si (KR); Jae-youn Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/531,916

(22) PCT Filed: Nov. 27, 2015

(86) PCT No.: PCT/KR2015/012853
§ 371 (c)(1),
(2) Date: May 31, 2017

(87) PCT Pub. No.: WO2016/089049
PCT Pub. Date: Jun. 9, 2016

(65) Prior Publication Data

US 2017/0325028 A1 Nov. 9, 2017

Related U.S. Application Data

(60) Provisional application No. 62/085,729, filed on Dec. 1, 2014.

(51) Int. Cl.

| | |
|---|---|
| ***H04R 5/04*** | (2006.01) |
| ***H04R 5/02*** | (2006.01) |
| ***H04R 3/12*** | (2006.01) |

(52) U.S. Cl.
CPC ..... *H04R 5/04* (2013.01); *H04R 3/12* (2013.01); *H04R 5/02* (2013.01);
(Continued)

(58) Field of Classification Search
CPC ..... H04R 5/04; H04R 5/02; H04R 2420/07; H04R 2430/01
See application file for complete search history.

(56) References Cited

U.S. PATENT DOCUMENTS 7,006,645 B2 2/2006 Fujita et al.
8,050,433 B2 11/2011 Kim
(Continued)

FOREIGN PATENT DOCUMENTS

CN 1942017 B 6/2012
CN 103856878 A 6/2014
(Continued)

OTHER PUBLICATIONS

International Search Report, issued by International Searching Authority in corresponding International Application No. PCT/KR2015/012853, dated Mar. 28, 2016, (PCT/ISA/210).
(Continued)

*Primary Examiner* — James Mooney
(74) *Attorney, Agent, or Firm* — Sughrue Mion, PLLC

(57) ABSTRACT

Provided is a method of processing an audio signal, the method performed by a device and including dividing the audio signal into a main signal and a background signal; obtaining position information about a main speaker and an auxiliary speaker; mixing the main signal and the background signal, based on the position information; and outputting the mixed main signal and the mixed background signal to the main speaker and the auxiliary speaker, respectively.

7 Claims, 13 Drawing Sheets

(52) U.S. Cl.
CPC .... *H04R 2205/024* (2013.01); *H04R 2420/07* (2013.01); *H04R 2430/01* (2013.01)

(56) References Cited

U.S. PATENT DOCUMENTS

| | | | | |
|---|---|---|---|---|
| 2009/0103737 | A1 | 4/2009 | Kim et al. | |
| 2010/0226500 | A1 | 9/2010 | Wang | |
| 2012/0140959 | A1 | 6/2012 | Fincham | |
| 2013/0156198 | A1* | 6/2013 | Kim | H04R 1/323 381/17 |
| 2014/0153752 | A1* | 6/2014 | Chon | H04S 7/303 381/303 |
| 2015/0358756 | A1* | 12/2015 | Harma | H04S 7/302 |
| 2016/0066118 | A1 | 3/2016 | Oh et al. | |
| 2016/0309279 | A1 | 10/2016 | Kim et al. | |

FOREIGN PATENT DOCUMENTS

| | | | |
|---|---|---|---|
| CN | 103999488 | A | 8/2014 |
| EP | 2 741 526 | B1 | 4/2017 |
| JP | 2004-56418 | A | 2/2004 |
| KR | 10-0739762 | B1 | 7/2007 |
| KR | 10-2007-0108341 | A | 11/2007 |
| KR | 10-2014-0127022 | A | 11/2014 |
| WO | 2014/122550 | A1 | 8/2014 |

OTHER PUBLICATIONS

Written Opinion, issued by International Searching Authority in corresponding International Application No. PCT/KR2015/012853, dated Mar. 28, 2016, (PCT/ISA/237).

Communication dated Aug. 14, 2018 issued by the State Intellectual Property Office of P.R China in Counterpart Chinese Application No. 201580075082.9.

* cited by examiner

METHOD AND DEVICE FOR OUTPUTTING AUDIO SIGNAL ON BASIS OF LOCATION INFORMATION OF SPEAKER

TECHNICAL FIELD

The present invention relates to a method and device for outputting an audio signal, based on position information about a speaker.

BACKGROUND ART

Since multimedia apparatuses have become slim and light-weight, a speaker with a low acoustic performance may be included in most multimedia apparatuses. Therefore, when a user watches a video by using a multimedia apparatus, the user may further use one or more high-performance speaker devices so as to reinforce an audio output function of the multimedia apparatus.

In this case, the user may listen to audio by using a plurality of speaker apparatuses. However, in a case of a wirelessly-connectable speaker apparatus, position movement of the speaker apparatus may frequently occur due to characteristics of wireless connection. Since a performance of an audio effect provided to the user may vary according to a position of the speaker apparatus, if audio is output without consideration of the position of the speaker apparatus, an optimal audio effect may not be provided to the user.

Therefore, there may be a demand for a method of outputting an audio signal, whereby, when a plurality of speakers are used, an optimal audio effect may be provided in consideration of position information about each of the speakers.

DETAILED DESCRIPTION OF THE INVENTION

Technical Solution

The present invention provides a method and device for processing and outputting an audio signal, whereby, when a plurality of speakers are used, an optimal audio effect may be provided in consideration of position information about each of the speakers.

Advantageous Effects

According to an embodiment, when a plurality of speakers are used, an optimal audio effect may be provided in consideration of position information about each of the speakers.

BEST MODE

Figure 1:
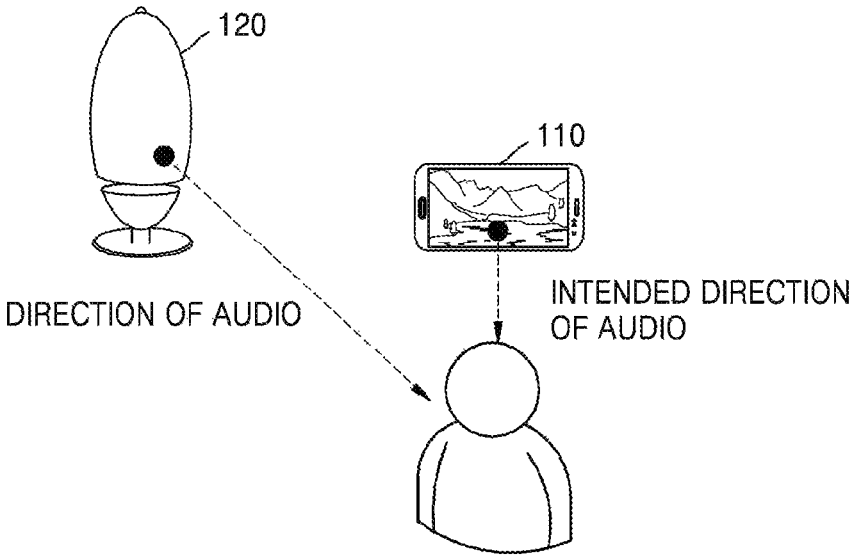
FIG. 1 illustrates an example of a speaker and a multimedia apparatus, according to an embodiment.

According to an embodiment, there is provided a method of processing an audio signal, the method performed by a device and including dividing the audio signal into a main signal and a background signal; obtaining position information about a main speaker and an auxiliary speaker; mixing the main signal and the background signal, based on the position information; and outputting the mixed main signal and the mixed background signal to the main speaker and the auxiliary speaker, respectively.

In addition, the mixing may include determining, based on the position information, a gain with respect to the main signal and a gain with respect to the background signal; generating the mixed background signal by mixing the background signal with the main signal to which the gain with respect to the main signal is applied; and generating the mixed main signal by mixing the main signal with the background signal to which the gain with respect to the background signal is applied.

In addition, the determining of the gains may include determining the gains with respect to the main signal and the background signal, respectively, based on a difference between an audio output direction of the main speaker and an audio output direction of the auxiliary speaker.

In addition, the determining of the gains may include setting a central axis, based on a position of the main speaker and a predetermined direction; and determining a value of the gain with respect to the main signal, wherein the value is inversely proportional to a distance between the auxiliary speaker and the central axis.

In addition, the determining of the gains may include determining a value of the gain with respect to the background signal, wherein the value is proportional to the distance between the auxiliary speaker and the central axis.

In addition, the dividing may include dividing the audio signal into the main signal and the background signal, based on at least one of correlation with a displayed screen corresponding to the audio signal, reproduction functions of the main speaker and the auxiliary speaker, and correlation between channels.

According to an embodiment, there is provided a device for processing an audio signal, the device including a receiving unit configured to receive the audio signal; a control unit configured to divide the audio signal into a main signal and a background signal, to obtain position information about a main speaker and an auxiliary speaker, and to mix the main signal and the background signal, based on the position information; and an output unit configured to output the mixed main signal and the mixed background signal to the main speaker and the auxiliary speaker, respectively.

MODE OF THE INVENTION

Hereinafter, embodiments of the present invention are described in detail with reference to attached drawings. In the following description and the attached drawings, well-known functions or constructions are not described in detail since they would obscure the present invention with unnecessary detail. Also, like reference numerals in the drawings denote like or similar elements throughout the specification.

Terms or words used in the following description should not be construed as being limited to common or general meanings but should be construed as fully satisfying the concept of the present invention, according to the principle by which an inventor may appropriately define terms so as to best describe his/her own invention. Therefore, the embodiments described in the specification and configurations shown in the drawings are merely examples of the present invention and do not represent all technical concepts of the present invention, and the present invention may include all revisions, equivalents, or substitutions which may be substituted with the embodiments at the time of filing.

In the attached drawings, some elements may be exaggerated, omitted, or roughly illustrated, and the size of each element does not exactly correspond to an actual size of each element. The present invention is not limited to relative sizes or gaps illustrated in the drawings.

Throughout the specification, when a part "includes" or "comprises" an element, unless there is a particular description contrary thereto, the part can further include other elements, not excluding the other elements. Also, when an element is referred to as being "connected to" or "coupled with" another element, it can be "directly connected to or coupled with" the other element, or it can be "electrically connected to or coupled with" the other element by having an intervening element interposed therebetween.

A singular form may include plural forms, unless there is a particular description contrary thereto. Terms such as "comprise" or "comprising" are used to specify existence of a recited form, a number, a process, an operation, a component, and/or groups thereof, not excluding the existence of one or more other recited forms, one or more other numbers, one or more other processes, one or more other operations, one or more other components and/or groups thereof.

The term "unit" used in the specification means a software component or hardware components such as an FPGA or an ASIC, and performs a specific function. However, the term "unit" is not limited to software or hardware. The "unit" may be formed so as to be in an addressable storage medium, or may be formed so as to operate one or more processors. Thus, for example, the term "unit" may refer to components such as software components, object-oriented software components, class components, and task components, and may include processes, functions, attributes, procedures, subroutines, segments of program code, drivers, firmware, micro codes, circuits, data, a database, data structures, tables, arrays, or variables. A function provided by the components and "unit" may be associated with the smaller number of components and "unit", or may be divided into additional components and "units".

The present invention will now be described more fully with reference to the accompanying drawings, in which exemplary embodiments of the invention are shown. The invention may, however, be embodied in many different forms and should not be construed as being limited to the embodiments set forth herein. In the following description, well-known functions or constructions are not described in detail since they would obscure the invention with unnecessary detail, and like reference numerals in the drawings denote like or similar elements throughout the specification.

Hereinafter, exemplary embodiments of the present invention will be described with reference to the attached drawings.

FIG. 1 illustrates an example of a speaker and a multimedia apparatus, according to an embodiment.

Referring to FIG. 1, a user may watch a multimedia image by using an auxiliary speaker 120 configured to improve an audio performance, and a multimedia apparatus 110. The multimedia apparatus 110 that displays the multimedia image may internally include a speaker so as to output an audio signal. The multimedia apparatus 110 may output an audio signal corresponding to the displayed multimedia image via the speaker included in the multimedia apparatus 110. The audio signal corresponding to the multimedia image may also be output via the auxiliary speaker 120 connected to the multimedia apparatus 110.

The high-performance auxiliary speaker 120 may complement the low-performance speaker in the multimedia apparatus 110. Audio of the multimedia image is output via not only the speaker of the multimedia apparatus 110 but also via the auxiliary speaker 120, so that a better audio effect performance may be provided to the user.

When the multimedia apparatus 110 and the auxiliary speaker 120 are connected, the audio signal may be output via only the auxiliary speaker 120. Alternatively, the audio signal may be divided into an audio signal to be output via the multimedia apparatus 110 and an audio signal to be output via the auxiliary speaker 120, and the audio signals may be output via the multimedia apparatus 110 and the auxiliary speaker 120, respectively.

It is assumed that, when the multimedia apparatus 110 is positioned in front of the user, it is desirable that audio is recognized toward the multimedia apparatus 110, according to an intention of a producer of the multimedia image. If the audio is output via the auxiliary speaker 120, unlike the intention of the producer, the audio may be recognized in a direction of the auxiliary speaker 120. Since the audio is output in an unintended direction due to a distance between the auxiliary speaker 120 and the multimedia apparatus 110, the user may feel unbalanced, distant, or the like due to the output audio.

Therefore, a device according to an embodiment may process the audio signal, so that a component of the audio signal in which directionality is important may be output via the multimedia apparatus 110, and a component of the audio signal in which the directionality is not important may be output via the auxiliary speaker 120. In addition, according to an audio output function of each speaker, the device may process the audio signal so that a component of the audio signal which may be more efficiently output via the auxiliary speaker 120 than via the multimedia apparatus 110 may be output via the auxiliary speaker 120.

Figure 2:
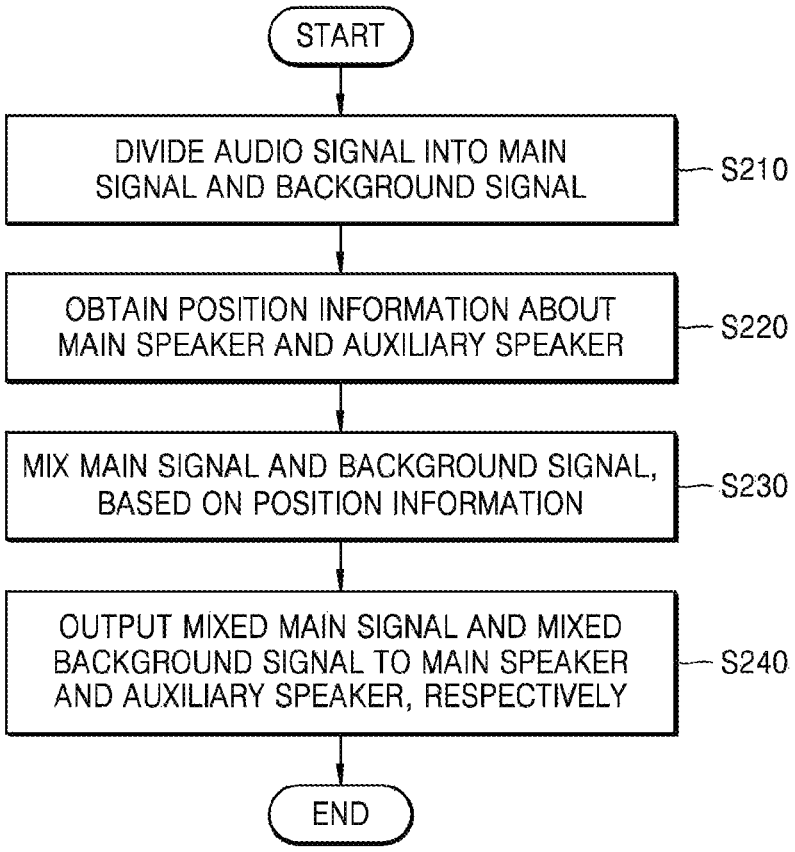
FIG. 2 is a flowchart illustrating a method of outputting an audio signal, based on position information about a speaker, according to an embodiment.

FIG. 2 is a flowchart illustrating a method of outputting an audio signal, based on speaker position information, according to an embodiment.

In the descriptions below, a device configured to process an audio signal may be an element that may be included in the multimedia apparatus 110 or the auxiliary speaker 120. However, the device is not limited thereto, and may be an externally existing device.

The audio signal may be output via a main speaker and at least one auxiliary speaker. The main speaker may indicate a speaker included in the multimedia apparatus 110 but is not limited thereto and may be one of various types of speakers. The main speaker may be an apparatus that is positioned in front of a user and outputs audio toward the user. Alternatively, the main speaker is not limited thereto, and may be an apparatus that outputs audio in at least one reference direction. The auxiliary speaker may be used an apparatus to complement an audio output function of the main speaker.

According to an embodiment, in order to provide an optimal audio effect to the user, the device may separately process and output audio signals to be output to the main speaker and the auxiliary speaker.

Referring to FIG. 2, in operation S210, the device may divide an output-target audio signal into a main signal and a background signal. The device may divide an audio signal component that is desirable to be output via the main speaker, into the main signal, and an audio signal component that is desirable to be output via the auxiliary speaker, into the background signal.

For example, since a voice or object clicking audio which has a relatively high correlation with an image or a screen displayed on a display is a signal component where directionality is important, the aforementioned audio signal components may be included in the main signal so as to be output in a reference direction. On the other hand, an audio signal component such as an audio effect, ambient audio, or the like in which the directionality is not important may be divided to the background signal. Also, a signal having a high correlation with respect to left and right channels may be divided to the main signal. According to the audio output function of the main speaker, an audio signal component of a band (e.g., a super-high frequency band or a super-low frequency band) which is difficult for the main speaker to optimally output may be divided to the background signal so as to be output via the high-performance auxiliary speaker.

In operation S220, the device may obtain position information about the main speaker and the auxiliary speaker. For example, the device may set a central axis with respect to positions of the main speaker and the user, and may calculate a distance between the auxiliary speaker and the center axis. The device may assume that the user is positioned in front of the main speaker and may determine the position of the user accordingly. However, the device is not limited thereto, and may set the central axis with respect to a preset position. The device may determine gain values to be used in mixing, based on the distance between the auxiliary speaker and the central axis.

In operation S230, the device may mix the main signal and the background signal, based on the position information about the main speaker and the auxiliary speaker, which are obtained in operation S220, and thus may generate a mixed main signal and a mixed background signal. The device may determine the gain values, based on the distance between the auxiliary speaker and the central axis which is calculated based on the information about the main speaker and the auxiliary speaker, and may mix the main signal and the background signal, based on the determined gain values.

The device may determine gains to be applied to the main signal and the background signal, respectively, based on the position information about the speakers, and may perform mixing by using the main signal and the background signal to which the different gains are applied. The main signal to which the gain with respect to the main signal is applied may be mixed with the background signal. Also, the background signal to which the gain with respect to the background signal is applied may be mixed with the main signal.

The gain value that may be determined based on the position information may be determined as a value less than 1. The gain value with respect to the main signal may be determined as a value that is inversely proportional to the distance between the central axis and the auxiliary speaker, and the gain value with respect to the background signal may be determined as a value that is proportional to the distance between the central axis and the auxiliary speaker.

When the distance between the central axis and the auxiliary speaker is decreased, a directional difference between the auxiliary speaker and the main speaker with respect to the position of the user or a predetermined position may be decreased. Thus, when the distance between the central axis and the auxiliary speaker is small, strange, unbalanced, etc. that the user may feel with respect to the main signal output from the auxiliary speaker may be lessened. Therefore, when the distance between the central axis and the auxiliary speaker is decreased, the gain value to be applied to the main signal that may be mixed with the background signal and may be output from the auxiliary speaker may be determined as a large value.

On the other hand, when the distance between the central axis and the auxiliary speaker is increased, a directional difference between the auxiliary speaker and the main speaker with respect to the position of the user may be increased. Therefore, when the distance between the central axis and the auxiliary speaker is increased, a directional difference between background signals output from the auxiliary speaker and the main speaker is increased, such that strange, unbalanced, etc. that the user may feel due to the directional difference between the background signals may be increased. The background signal may include an audio signal having relatively less directionality than the main signal, but, if a directional difference with respect to a display image is increased, strange, unbalanced, etc. that the user may feel may be increased. Therefore, the device may determine the gain in such a manner that a percentage of the background signal output from the main speaker may be increased, and by doing so, strange, unbalanced, etc. that the user may feel due to a difference between directionalities of audio signals may be decreased. When the distance between the central axis and the auxiliary speaker is increased, the gain value to be applied to the background signal that is to be mixed with the main signal and is to be output from the main speaker may be determined as the large value.

The device may generate, by using the determined gain values, the mixed main signal to be output from the main speaker, and the mixed background signal to be output from the auxiliary speaker.

In operation S240, the device may output the mixed main signal and the mixed background signal, which are obtained in operation S250, to the main speaker and the auxiliary speaker, respectively. The audio signal may be output after being processed such that a percentage of the main signal and the background signal included in a mixed signal is adjusted based on the position information about the speakers, and thus strange, unbalanced, etc. that the user may feel due to the difference between the directionalities of the audio signals may be minimized.

Figure 3:
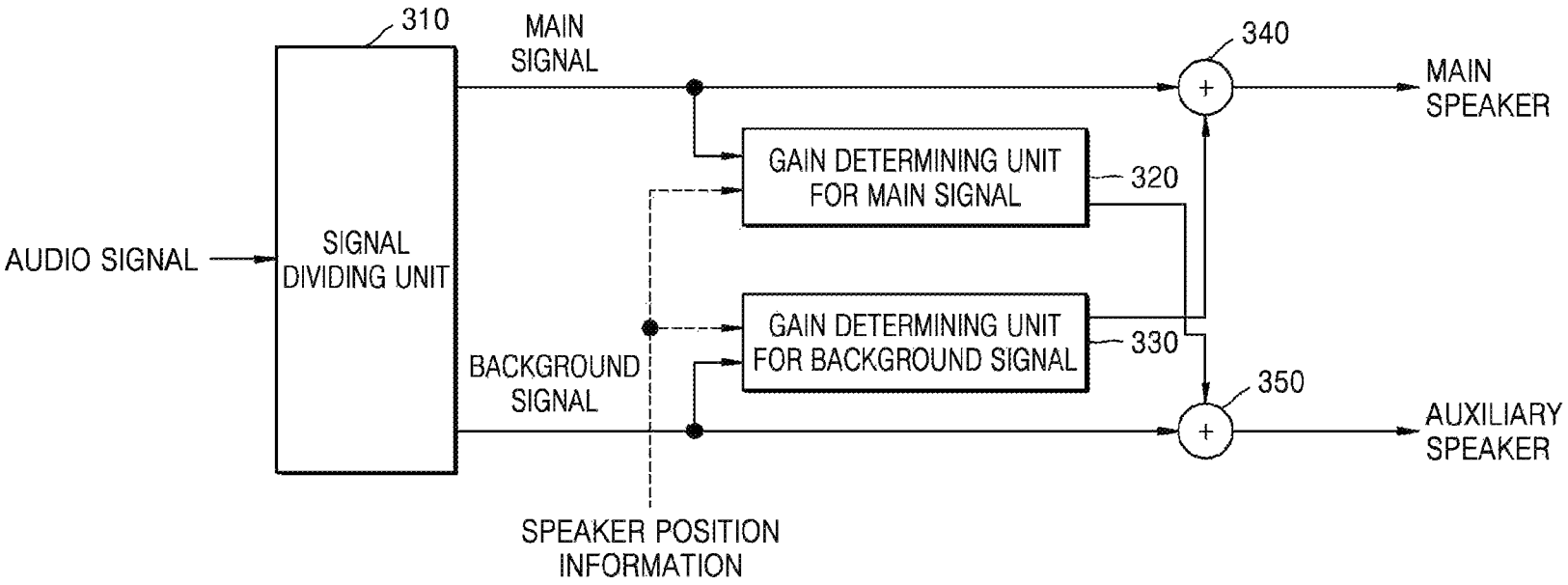
FIG. 3 is a block diagram illustrating an internal structure of a device that outputs an audio signal, based on speaker position information, according to an embodiment.

FIG. 3 is a block diagram illustrating an internal structure of a device that outputs an audio signal, based on speaker position information, according to an embodiment.

Referring to FIG. 3, a device 300 may include a signal dividing unit 310 configured to divide an audio signal, gain determining units 320 and 330 configured to determine gains with respect to a main signal and a background signal, and adders 340 and 350. The device 300 of FIG. 3 may correspond to the device of FIG. 2.

The signal dividing unit 310 may divide the audio signal, which is input to the device 300, into the main signal and the background signal. The signal dividing unit 310 may divide an audio signal component that is desirable to be output via a main speaker, into the main signal, and an audio signal component that is desirable to be output via an auxiliary speaker, into the background signal.

The gain determining unit 320 with respect to the main signal may determine a gain to be applied to the main signal, based on position information about the main speaker and the auxiliary speaker. A gain value with respect to the main signal may be determined as a value that is inversely proportional to a distance between a central axis and the auxiliary speaker. When the distance between the central axis and the auxiliary speaker is decreased, strange, unbalanced, etc. with respect to the main signal output from the auxiliary speaker is decreased, thus, the gain determining unit 320 with respect to the main signal may determine, as a large value, the gain value to be applied to the main signal that may be mixed with the background signal and may be output from the auxiliary speaker.

The gain determining unit 330 with respect to the background signal may determine a gain to be applied to the background signal, based on the position information about the main speaker and the auxiliary speaker. A gain value with respect to the background signal may be determined as a value that is proportional to the distance between the central axis and the auxiliary speaker. As the distance between the central axis and the auxiliary speaker is increased, the gain is determined so that a percentage of the background signal output from the main speaker is increased, and by doing so, strange, unbalanced, etc. that a user may feel due to a difference between directionalities of audio signals may be decreased. As the distance between the central axis and the auxiliary speaker is increased, the gain determining unit 330 with respect to the background signal may determine, as a large value, the gain value to be applied to the background signal that may be mixed with the main signal and may be output from the main speaker.

The main signal separated from the audio signal, by the signal dividing unit 310, may be mixed, by the adder 340, with the background signal to which the gain with respect to the background signal is applied and may be output. The main signal mixed by the adder 340 may be output to the main speaker.

The background signal separated from the audio signal, by the signal dividing unit 310, may be mixed, by the adder 350, with the main signal to which the gain with respect to the main signal is applied and may be output. The background signal mixed by the adder 350 may be output to the auxiliary speaker.

By using the device 300 according to an embodiment, the audio signal may be output after being processed such that a percentage of the main signal and the background signal included in a mixed signal is adjusted based on the position information about the speakers, and thus strange, unbalanced, etc. that the user may feel due to the difference between the directionalities may be minimized.

Figure 4:
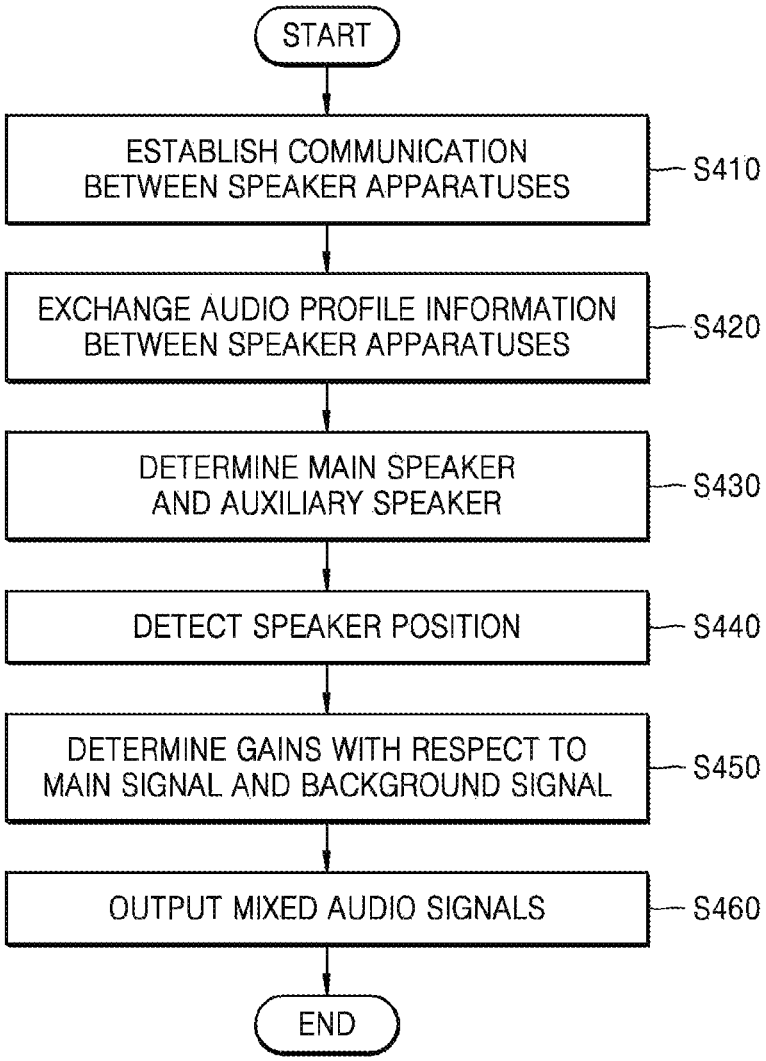
FIG. 4 is a flowchart illustrating a method of outputting an audio signal, based on speaker position information, according to an embodiment.

FIG. 4 is a flowchart illustrating a method of outputting an audio signal, based on speaker position information, according to an embodiment.

The method illustrated in FIG. 4 may correspond to the method illustrated in FIG. 2, and repeated descriptions may be skipped.

Referring to FIG. 4, in operation S410, speaker apparatuses are connected to each other so that communication between the speaker apparatuses may be available. For example, a display apparatus having a speaker and a wireless speaker may be connected to each other via wired or wireless communication. The device 300 configured to process an audio signal based on speaker position information may be included in the display apparatus, and hereinafter, operations S420 through S470 are described. The device 300 may perform operations S420 through S470 below.

In operation S420, audio profile information may be exchanged between the speaker apparatuses that are connected to each other in operation S410. For example, audio profile information of a speaker apparatus from among the connected speaker apparatuses may be transmitted to another speaker apparatus including a device configured to process an audio signal. The audio profile information may include information about an audio output function of the speaker apparatus. Based on the information about the audio output function, the audio signal may be divided into a main signal and a background signal.

In operation S430, a main speaker and an auxiliary speaker may be determined based on the audio profile information exchanged in operation S420. For example, the speaker of the multimedia apparatus including a display may be determined as the main speaker, and another speaker apparatus may be determined as the auxiliary speaker. As another example, a speaker capable of outputting the audio signal in a reference direction may be determined as the main speaker, and another speaker apparatus may be determined as the auxiliary speaker. From among the speaker apparatuses, a speaker having a relatively high audio output function may be determined as the auxiliary speaker. According to embodiments, one or more auxiliary speakers may be present.

In operation S440, a process may be performed to detect a speaker position, such that the speaker position information may be obtained. For example, an audio signal output from the auxiliary speaker is received by using a microphone of the display apparatus, such that position information of each speaker may be obtained. Based on a time when the microphone of the display apparatus receives the audio signal output from the auxiliary speaker, and a magnitude of the audio signal, the position information of each speaker may be obtained.

In operation S450, gains with respect to the main signal and the background signal may be determined based on the position information of each speaker. The gains with respect to the main signal and the background signal may be determined according to the method of FIGS. 2 and 3.

In operation S460, the device 300 may generate a main signal and a background signal that are mixed by using gain values determined in operation S450, and may output the mixed main signal and the mixed background signal to the main speaker and the auxiliary speaker.

Figure 5:
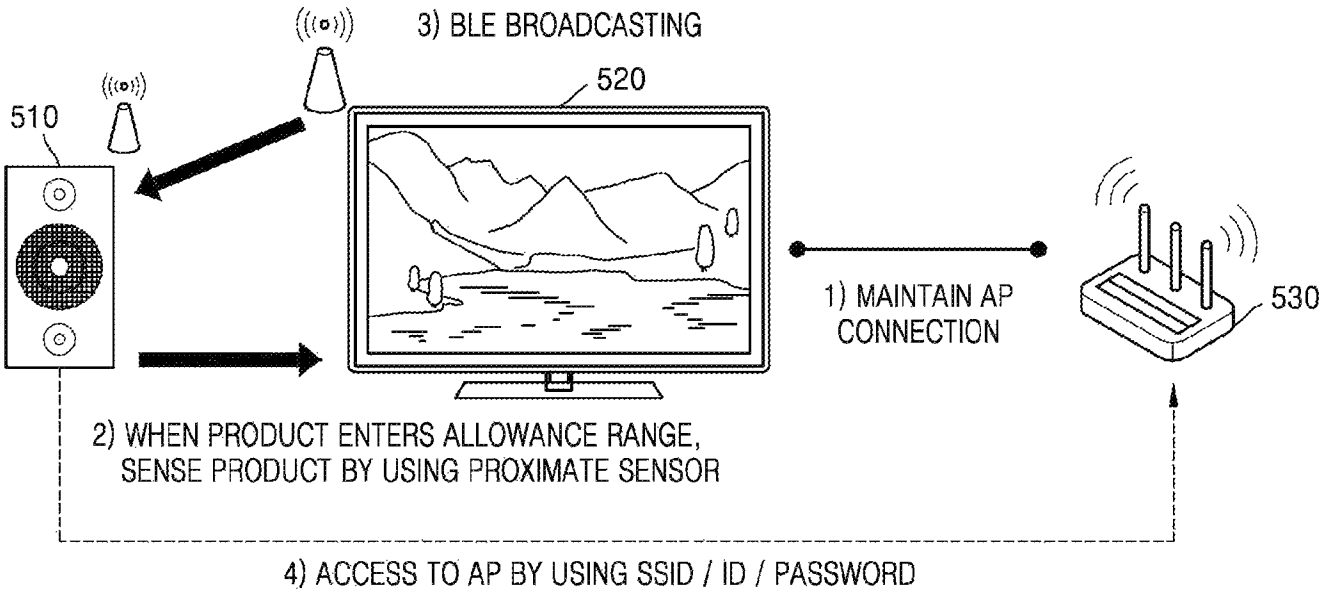
FIG. 5 illustrates an example where a plurality of speaker apparatuses are connected to each other via wireless communication, according to an embodiment.

FIG. 5 illustrates an example where a plurality of speaker apparatuses are connected to each other via wireless communication, according to an embodiment.

The embodiment shown in FIG. 5 may be included in the embodiment of FIG. 4 in which the speaker apparatuses are connected to each other via the wired or wireless communication.

Referring to FIG. 5, a speaker apparatus 520 may be in a state where the speaker apparatus 520 is previously connected to an access point (AP) 530. The speaker apparatus 520 that is previously connected to the AP 530 may be a terminal apparatus such as a smartphone, a smart TV, or the like that a user may use.

When the existing speaker apparatus 520 senses a new speaker apparatus 510 by using a proximate sensor arranged in the speaker apparatus 520 or via Bluetooth Low Energy broadcasting (BLE broadcasting), the sensed speaker apparatus 510 may be connected to the existing speaker apparatus 520. An authentication process with respect to the new speaker apparatus 510 may be performed in the existing speaker apparatus 520. When the authentication with respect to the new speaker apparatus 510 is completed, the new speaker apparatus 510 may receive service set identifier (SSID) information, identifier (ID) information, and password information from the existing speaker apparatus 520, and may access the AP 530 by using the plurality of pieces of received information.

When the new speaker apparatus 510 accesses the AP 530, the new speaker apparatus 510 and the existing speaker apparatus 520 may be connected to each other. The user may control the new speaker apparatus 510 by using a control means of the existing speaker apparatus 520. For example, according to an embodiment, the user may control an audio signal to be output to the speaker apparatuses 510 and 520, wherein the audio signal is processed based on position information about the speaker apparatuses 510 and 520. The new speaker apparatus 510 may be determined as an auxiliary speaker, and the existing speaker apparatus 520 may be determined as a main speaker, so that the speaker apparatuses 510 and 520 may respectively output a mixed background signal and a mixed main signal.

Figure 6:
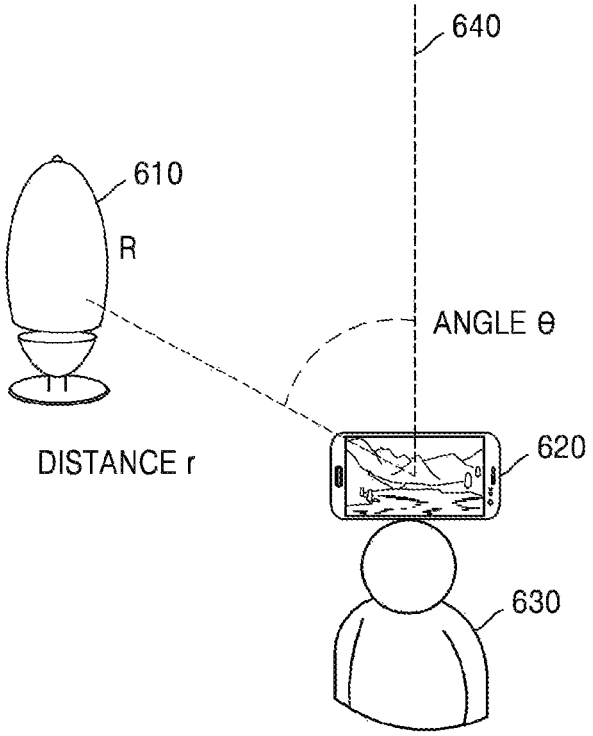
FIG. 6 illustrates an example of position information about a main speaker and an auxiliary speaker, according to an embodiment.

FIG. 6 illustrates an example of position information about a main speaker and an auxiliary speaker, according to an embodiment.

Referring to FIG. 6, position information about a main speaker 620 and an auxiliary speaker 610 may include information about a distance r between the main speaker 620 and the auxiliary speaker 610 and an angle θ between a central axis 640 and the auxiliary speaker 610. A distance (r*sin θ) between the auxiliary speaker 610 and the central axis 640 may be obtained from the position information about the main speaker 620 and the auxiliary speaker 610.

The central axis 640 may be set with respect to the main speaker 620 and a user's position 630. The user's position 630 may be determined based on position information measured by a terminal apparatus, e.g., a smart watch, smartglasses, or the like that the user carries. Alternatively, since a user may face a display screen, the user's position 630 may be in front of the main speaker 620.

Figure 7:
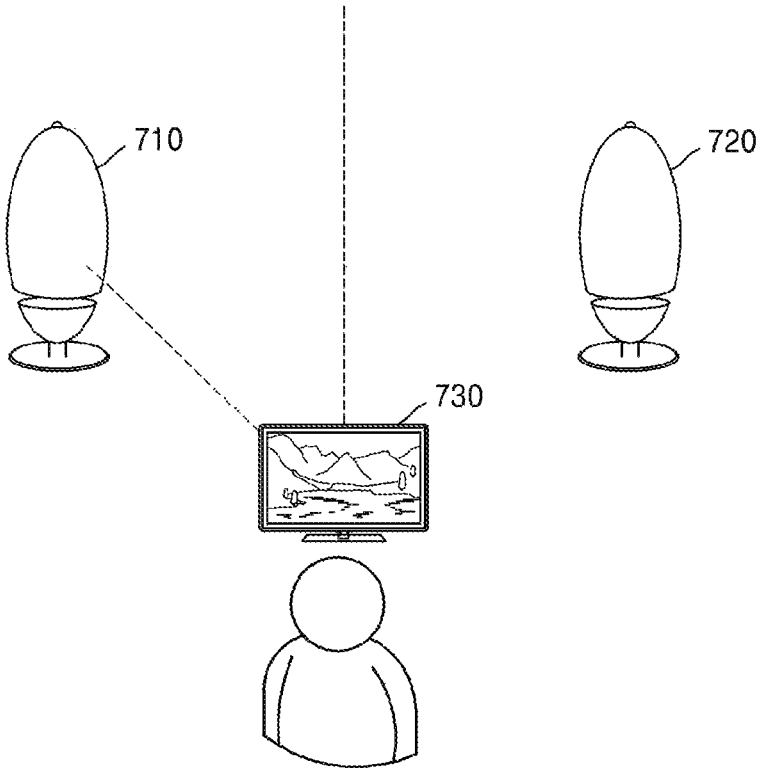
FIG. 7 illustrates an example of a plurality of auxiliary speakers and a main speaker, according to an embodiment.

FIG. 7 illustrates an example of a plurality of auxiliary speakers and a main speaker, according to an embodiment.

Referring to FIG. 7, a main speaker 730 and two auxiliary speakers 710 and 720 that are capable of outputting an audio signal corresponding to an image displayed on a multimedia apparatus of the main speaker 730 may be present. The auxiliary speaker 710 in a left side may output an audio signal of a left (L) channel, and the auxiliary speaker 720 in a right side may output an audio signal of a right (R) channel.

The device 300 may separate background signals corresponding to the number of the auxiliary speakers 710 and 720 from the audio signal. For example, the device 300 may separate, from the audio signal, an L background signal to be output to the auxiliary speaker 710 in the left side, and a R background signal to be output to the auxiliary speaker 720 in the right side.

The device 300 may determine a gain with respect to a main signal, based on a distance between a central axis and the auxiliary speakers 710 and 720. For example, the gain with respect to the main signal may be determined based on an average distance between the central axis and the auxiliary speakers 710 and 720. Also, the device 300 may respectively determine gains with respect to the L background signal and the R background signal, based on distances between the central axis and the auxiliary speakers 710 and 720.

The device 300 may mix the main signal with the L background signal and the R background signal to which the gains with respect to the background signals are applied, and thus may generate a main signal to be output from the main speaker 730. In addition, the device 300 may mix the L background signal and the main signal to which the gain with respect to the main signal is applied, and thus may generate a mixed L background signal to be output from the auxiliary speaker 710 in the left side. Likewise, the device 300 may mix the R background signal and the main signal to which the gain with respect to the main signal is applied, and thus may generate a mixed R background signal to be output from the auxiliary speaker 720 in the right side.

Figure 8:
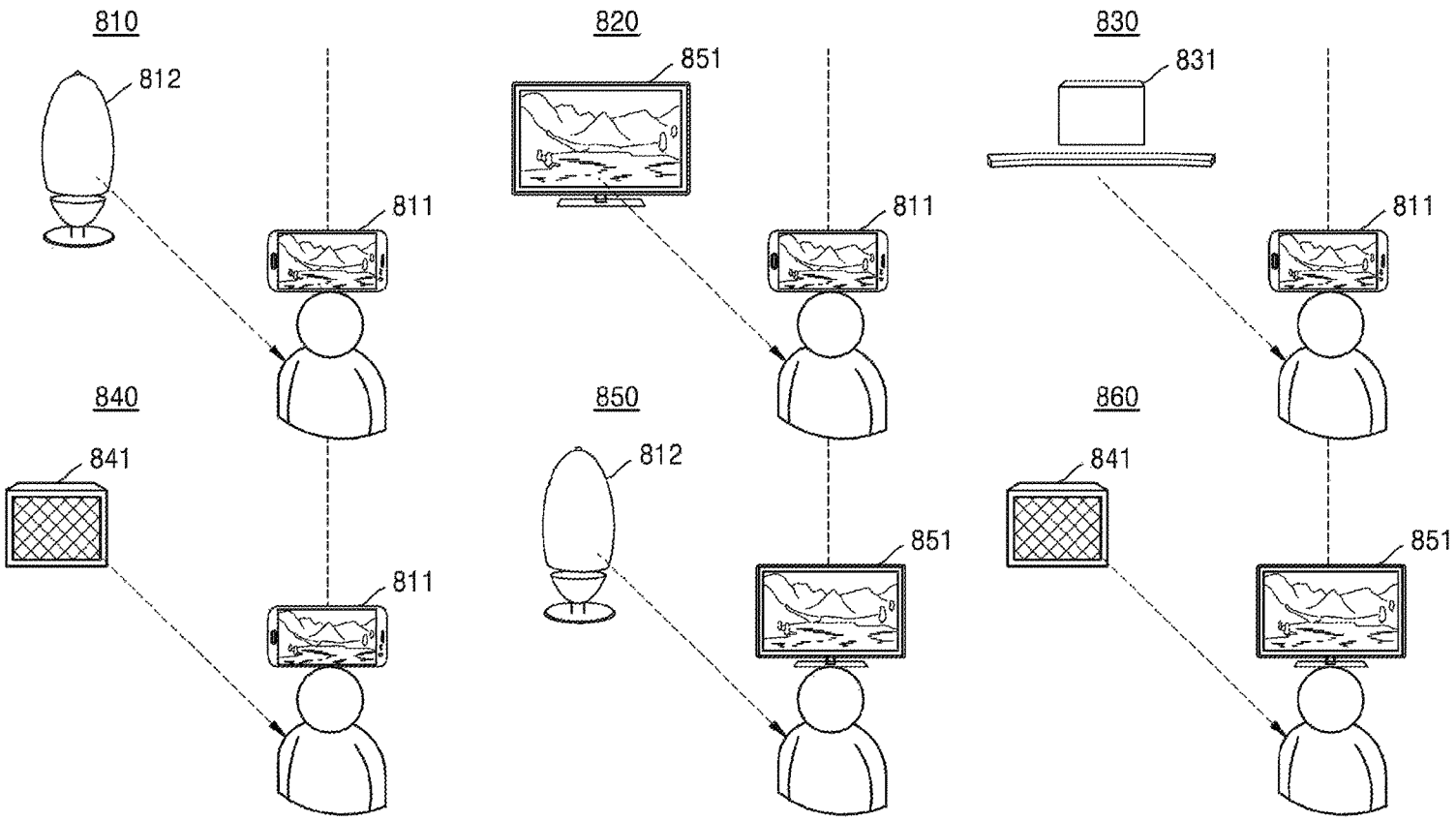
FIG. 8 illustrates an example of a main speaker and an auxiliary speaker, according to an embodiment.

FIG. 8 illustrates an example of a main speaker and an auxiliary speaker, according to an embodiment.

As illustrated in 810 through 860, an embedded speaker 811 of a smartphone or an embedded speaker 851 of a television (TV) may be set as a main speaker. An embedded speaker of a terminal apparatus capable of displaying an image may be determined as the main speaker.

As illustrated in 810 through 860, a wireless speaker 812, the embedded speaker 851 of the TV, a sound bar 831, a sub-woofer 841, or the like may be set as auxiliary speakers. Speakers having an audio output performance higher than that of the main speaker may be set as the auxiliary speakers.

Figure 9:
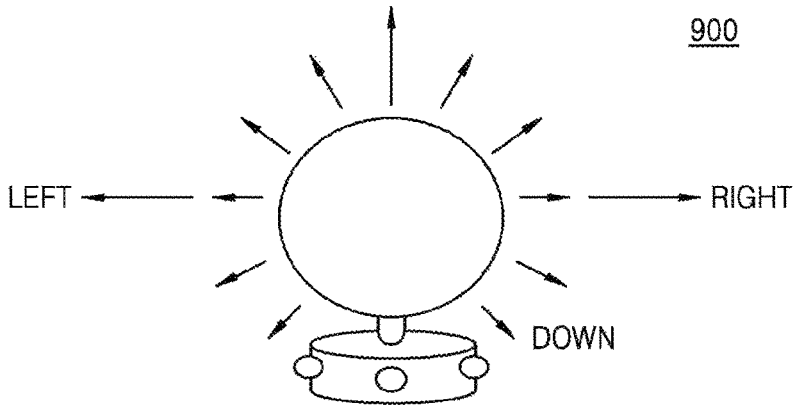
FIG. 9 illustrates an example of a speaker, according to an embodiment.

FIG. 9 illustrates an example of a speaker, according to an embodiment.

A speaker 900 illustrated in FIG. 9 may be set as the main speaker or the auxiliary speaker and may output an audio signal.

Referring to FIG. 9, the speaker 900 may perform radiation in an omnidirection. For example, the speaker 900 may output the audio signal in up and down-right and left directions. The speaker 900 may output different audio signals in right and left directions or up and down directions, and may be designed in such a manner that various sound field feelings may be perceived according to listening positions.

For example, a horizontal-direction unit from among output units of the speaker 900 may output audio signals of left and right channels according to left and right directions. Also, a vertical-direction unit of the speaker 900 may output a signal obtained by mixing the audio signal of the left channel and the audio signal of the right channel.

In addition, in case a user's position is identifiable, each directional unit of the speaker 900 may output the audio signals of the left and right channels with respect to the user's position such that the user may feel a sense of presence.

Figure 10:
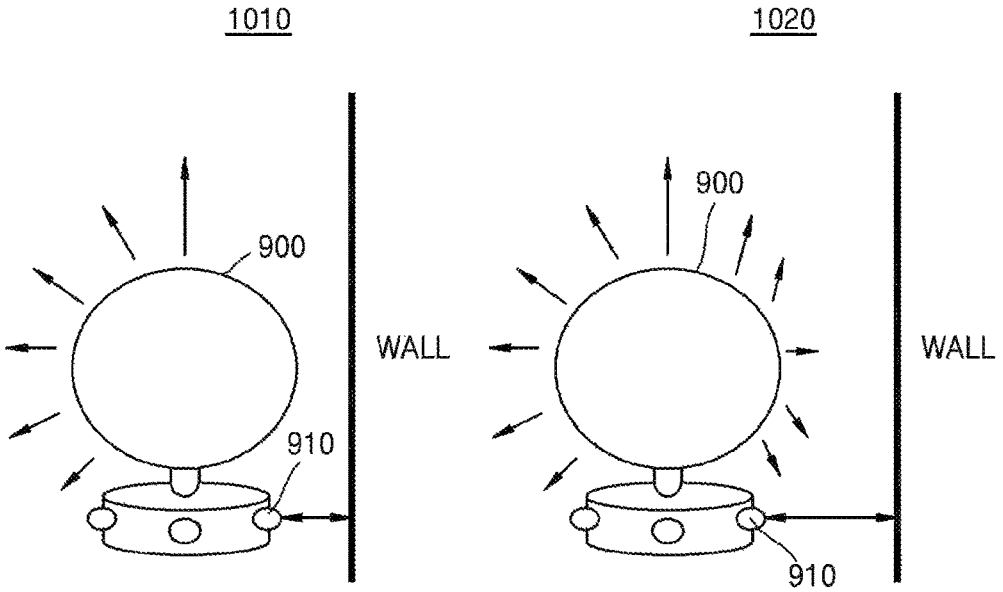
FIG. 10 illustrates an example of a speaker configured to output an audio signal by taking into account a location of a wall, according to an embodiment.

FIG. 10 illustrates an example of a speaker configured to output an audio signal by taking into account a location of a wall, according to an embodiment.

Referring to FIG. 10, the speaker 900 may have a wall recognition sensor 910 and thus may sense the location of the wall. The wall recognition sensor 910 may obtain a distance between the speaker 900 and the wall by outputting a signal such as ultrasound, an infrared ray, and the like in a predetermined direction, and obtaining a time period in which the output signal is reflected and is re-input to the wall recognition sensor 910. The speaker 900 may adjust a magnitude of the audio signal radiated toward the wall, based on the distance between the speaker 900 and the wall.

When the wall is present near the speaker 900, the audio signal output from the speaker 900 may be reflected from the wall and thus may be distorted. Therefore, in order to prevent that the audio signal with the distortion is radiated, the speaker 900 may adjust the audio signal, which is to be radiated toward the wall, based on the distance between the wall and the speaker 900 and may output the audio signal.

For example, as illustrated in 1010, when the distance between the speaker 900 and the wall is small, an output of the audio signal to be radiated toward the wall may be minimized. As illustrated in 1020, when the distance between the speaker 900 and the wall is increased, the output of the audio signal to be radiated toward the wall may be adjusted to be increased.

Figure 11:
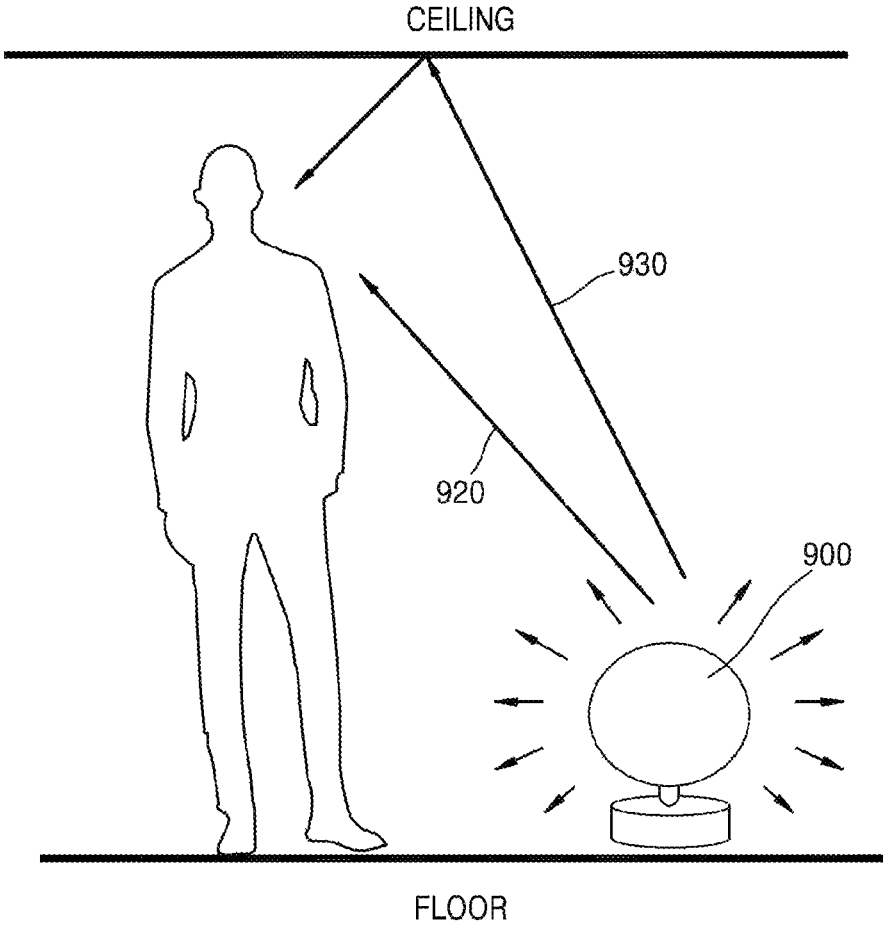
FIG. 11 illustrates an example of a speaker configured to output an audio signal by taking into account a position of a user, according to an embodiment.

FIG. 11 illustrates an example of a speaker configured to output an audio signal by taking into account a position of a user, according to an embodiment.

Referring to FIG. 11, when a listening-position of the user is above the speaker 900, the speaker 900 may directly radiate an audio signal toward the position of the user (refer to 920), or may radiate an audio signal toward a ceiling (refer to 930). The audio signal radiated toward the ceiling (refer to 930) may be reflected from the ceiling and may be directly delivered to the user, such that the user may further clearly listen to audio.

Figure 12:
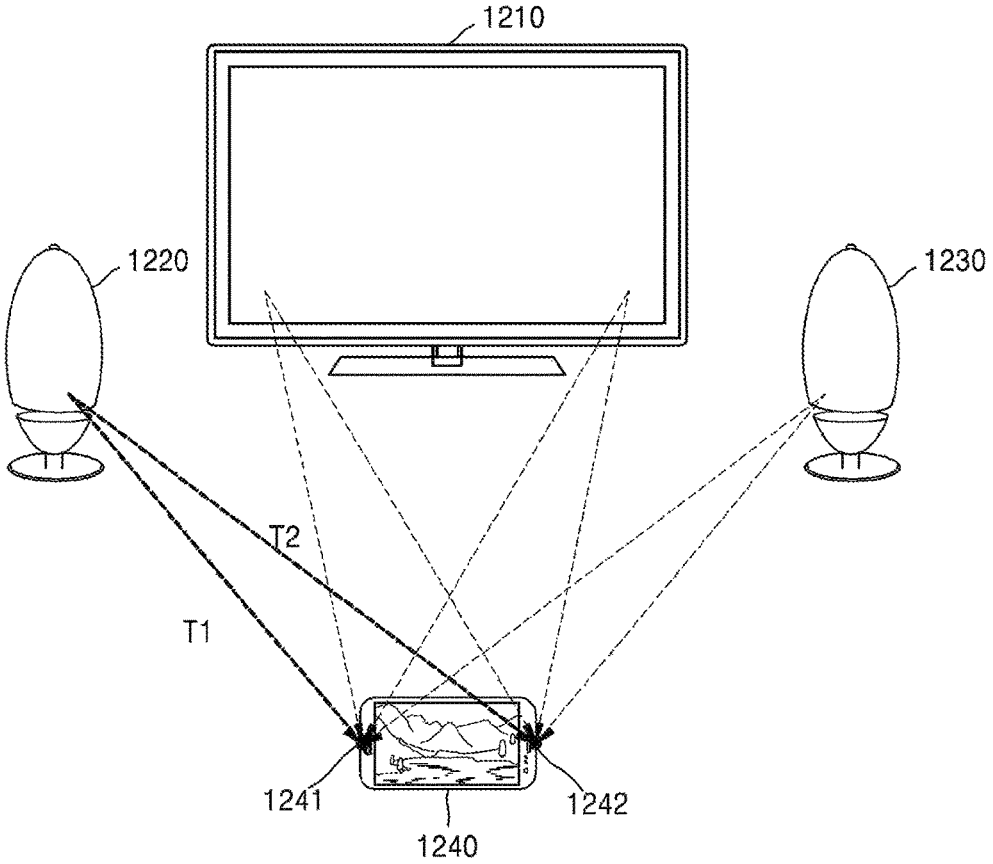
FIG. 12 illustrates an example of a method of obtaining position information about a speaker, according to an embodiment.

FIG. 12 illustrates an example of a method of obtaining position information about a speaker, according to an embodiment.

Referring to FIG. 12, position information about speakers 1210, 1220, and 1230 may be obtained by a terminal apparatus 1240 having microphones 1241 and 1242. The terminal apparatus 1240 may obtain the position information about the speakers 1210, 1220, and 1230 by sensing audios output from the speakers 1210, 1220, and 1230 via the microphones 1241 and 1242.

The audio output from the speaker 1220 may be sensed via the microphones 1241 and 1242 of the terminal apparatus 1240. Since a distance between a speaker and the microphones 1241 and 1242 vary according to positions of the microphones 1241 and 1242, sensing times with respect to same audio are different from each other. Based on a time difference between arrivals obtained from sensing times T1 and T2, a distance between the speaker 1220 and each of the microphones 1241 and 1242 may be obtained. In addition, according to a distance between the microphones 1241 and 1242, an angle between a central axis of the terminal apparatus 1240 and the speaker 1220 may be obtained. The central axis of the terminal apparatus 1240 may be set with respect to a front direction of the terminal apparatus 1240.

Figure 13:
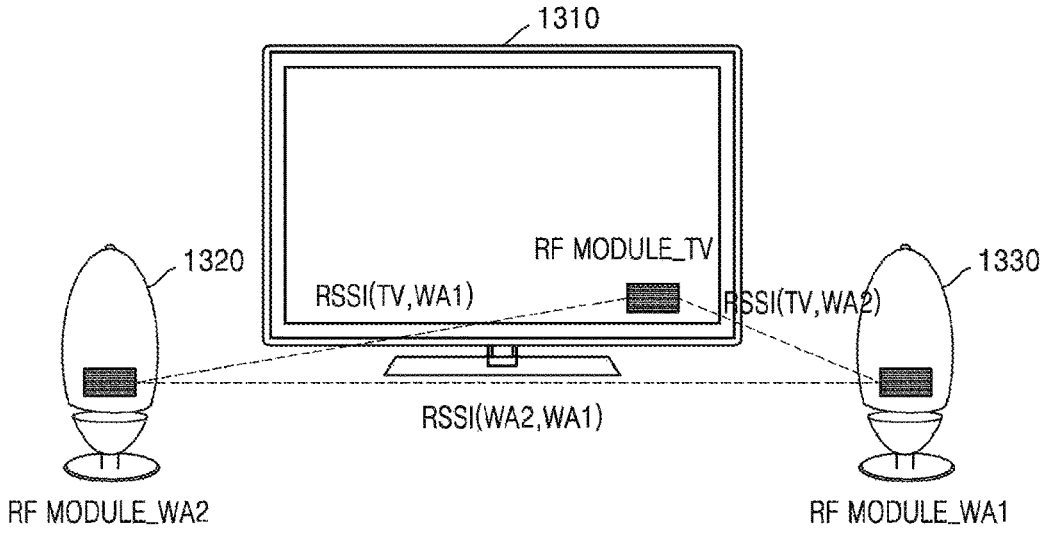
FIG. 13 illustrates an example of a method of obtaining position information about a speaker, according to an embodiment.

FIG. 13 illustrates an example of a method of obtaining position information about a speaker, according to an embodiment.

Referring to FIG. 13, information about a distance between speaker apparatuses 1320 and 1330 and a terminal apparatus 1310 may be obtained via received signal strength indication (RSSI) of a wireless signal. By comparing measured RSSIs, it is possible to determine in which direction the speaker apparatuses 1320 and 1330 are positioned with respect to the terminal apparatus 1310. The terminal apparatus 1310 may process an audio signal according to the positions of the speaker apparatuses 1320 and 1330, so that audios that are different from each other may be output to the speaker apparatuses 1320 and 1330.

A radio frequency (RF) module capable of measuring RSSI may be included in each of the terminal apparatus 1310, the speaker apparatus 1320, and the speaker apparatus 1330. Hereinafter, the RF modules included in the terminal apparatus 1310, the speaker apparatus 1320, and the speaker apparatus 1330 are referred to as an RF module_TV, an RF module_WA1, and an RF module_WA2. TV, WA1, and WA2 indicate the terminal apparatus 1310, the speaker apparatus 1320, and the speaker apparatus 1330, respectively.

The RF module_TV that is the RF module of the terminal apparatus 1310 is arranged on one side of a left side and a right side, such that it is possible to determine, by comparing the RSSIs, in which direction the speaker apparatuses 1320 and 1330 are positioned with respect to the terminal apparatus 1310. A speaker apparatus with a greater RSSI from among RSSI(WA1, TV) and RSSI(WA2, TV) may be positioned closer to the RF module_TV.

RSSI(TV, WA1), RSSI(WA2, WA1), and RSSI(TV, WA2) shown in FIG. 13 indicate RSSIs sensed among the terminal apparatus 1310 and the speaker apparatuses 1320 and 1330. By comparing the sensed RSSIs with each other, it is possible to determine in which direction the speaker apparatuses 1320 and 1330 are positioned with respect to the terminal apparatus 1310.

In a case of RSSI(WA1, TV)>RSSI(WA2, TV), RSSI(WA1, WA2)<RSSI(WA1, TV), RSSI(WA1, WA2)<RSSI(WA2, TV), the speaker apparatuses 1320 and 1330 may be determined to be present in a left side and a right side, respectively, with respect to the terminal apparatus 1310.

In a case of RSSI(WA1, TV)>RSSI(WA2, TV), RSSI(WA1, WA2)<RSSI(WA1, TV), RSSI(WA1, WA2)<RSSI(WA2, TV), the speaker apparatuses 1320 and 1330 may be determined to be present in a right side and a left side, respectively, with respect to the terminal apparatus 1310.

Figure 14:
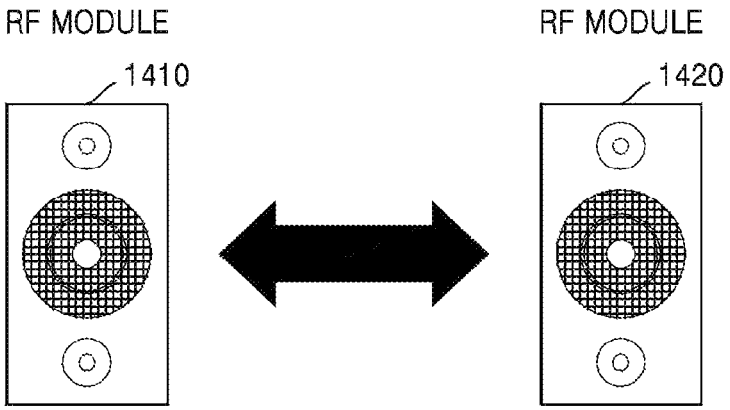
FIG. 14 illustrates an example of a method of measuring a distance between speaker apparatuses, according to an embodiment.

FIG. 14 illustrates an example of a method of measuring a distance between speaker apparatuses, according to an embodiment.

Referring to FIG. 14, the distance between the speaker apparatuses may be measured by a proximate sensor, e.g., an RF module, included in speaker apparatuses 1410 and 1420.

According to an RSSI value measured by the RF module, the distance between the speaker apparatuses 1410 and 1420 may be measured. When the RSSI value is small, the distance between the speaker apparatuses 1410 and 1420 may be determined as a large value.

Figure 15:
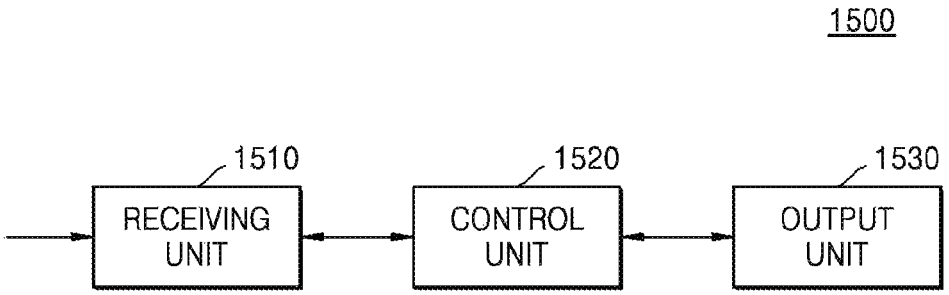
FIG. 15 is a block diagram illustrating an internal structure of a device, according to an embodiment.

FIG. 15 is a block diagram illustrating an internal structure of a device, according to an embodiment.

Referring to FIG. 15, a device 1500 may include a receiving unit 1510, a control unit 1520, and an output unit 1530.

The receiving unit 1510 may receive an audio signal to be output via a speaker. The audio signal that may be received by the receiving unit 1510 may correspond to an image or a screen that is displayed.

The control unit 1520 may divide the audio signal, which is received by the receiving unit 1510, into a main signal and a background signal. The control unit 1520 may mix the main signal and the background signal, based on position information about a main speaker and an auxiliary speaker, and thus may generate a mixed main signal and a mixed background signal. The position information about the main speaker and the auxiliary speaker may be received from an external source by the receiving unit 1510, or may be obtained according to the aforementioned method of obtaining position information about a speaker. The control unit 1520 may determine gain values, based on the position information about the main speaker and the auxiliary speaker, and may mix the main signal and the background signal according to the determined gain values.

When a distance between a central axis and the auxiliary speaker is decreased, the gain value to be applied to the main signal that may be mixed with the background signal and may be output from the auxiliary speaker may be determined as a large value. On the other hand, when the distance between the central axis and the auxiliary speaker is increased, the gain value to be applied to the background signal that is to be mixed with the main signal and is to be output from the main speaker may be determined as a large value.

The output unit 1530 may output, to the main speaker, the mixed main signal to be output via the main speaker, and may output, to the auxiliary speaker, the mixed background signal to be output via the auxiliary speaker.

According to an embodiment, when a plurality of speakers are used, an audio signal may be processed and output such that an optimal audio effect may be provided in consideration of position information about each of the speakers.

The method according to some embodiments can be embodied as programmed commands to be executed in various computer means, and then can be recorded to a computer readable recording medium. The computer readable recording medium may include one or more of the programmed commands, data files, data structures, or the like. The programmed commands recorded to the computer readable recording medium may be particularly designed or configured for the invention or may be well known to one of ordinary skill in the art. Examples of the computer readable recording medium include magnetic media including hard disks, magnetic tapes, and floppy disks, optical media including CD-ROMs, and DVDs, magneto-optical media including floptical disks, and a hardware apparatus designed to store and execute the programmed commands in ROM, RAM, flash memories, and the like. Examples of the programmed commands include not only machine codes generated by a compiler but also include great codes to be executed in a computer by using an interpreter.

While the detailed description has been particularly described with reference to non-obvious features of the present invention, it will be understood by one of ordinary skill in the art that various deletions, substitutions, and changes in form and details of the aforementioned apparatus and method may be made therein without departing from the spirit and scope of the following claims. Therefore, the scope of the present invention is defined not by the detailed description but by the appended claims, and all differences within the scope will be construed as being included in the present invention.

The invention claimed is:

1. A method of processing an audio signal, the method performed by a device and comprising:

dividing the audio signal into a first signal and a second signal;

obtaining relative position information between a first speaker and a second speaker;

determining a first gain for the first signal and a second gain for the second signal, based on the relative position information;

obtaining a third signal by mixing the second signal, to which the second gain is applied, and the first signal;

obtaining a fourth signal by mixing the first signal, to which the first gain is applied, and the second signal;

outputting the third signal to the first speaker; and outputting the fourth signal to the second speaker, wherein the determining of the first gain for the first signal and the second gain for the second signal comprises:

setting a central axis based on positions of the first speaker and a user;

determining the first gain as a first value inversely proportional to a distance between the second speaker and the central axis; and determining the second gain as a second value proportional to the distance between the second speaker and the central axis.

2. The method of claim 1, wherein the determining of the first gain and the second gain comprises obtaining a difference between a first audio output direction of the first speaker and a second audio output direction of the second speaker based on the relative position information and determining the first gain and the second gain based on the difference.

3. The method of claim 1, wherein the dividing comprises dividing the audio signal into the first signal and the second signal, based on directionality of each component of the audio signal.

4. A non-transitory computer-readable recording medium having recorded thereon a program for implementing the method of claim 1.

5. A device for processing an audio signal, the device comprising:

a memory storing instructions; and;

at least one processor configured to execute the stored instructions to:

divide the audio signal into a first signal and a second signal, obtain relative position information between a first speaker and a second speaker, determine a first gain for the first signal and a second gain for the second signal, based on the relative position information, obtain a third signal by mixing the second signal, to which the second gain is applied, and the first signal, obtain a fourth signal by mixing the first signal, to which the first gain is applied, and the second signal, and output the third signal to the first speaker and output the fourth signal to the second speaker, wherein the at least one processor is further configured to:

set a central axis based on positions of the first speaker and a user, determine the first gain as a first value inversely proportional to a distance between the second speaker and the central axis, and determine the second gain as a second value proportional to the distance between the second speaker and the central axis.

6. The device of claim 5, wherein the at least one processor is further configured to:

obtain a difference between a first audio output direction of the first speaker and a second audio output direction of the second speaker based on the relative position information and determine the first gain and the second gain based on the difference.

7. The device of claim 5, wherein the at least one processor is further configured to divide the audio signal into the first signal and the second signal, based on directionality of each component of the audio signal.

* * * * *